United States Patent [19]

Millhimes et al.

[11] 4,313,646

[45] Feb. 2, 1982

[54] POWER DISTRIBUTION SYSTEM

[75] Inventors: Wayne L. Millhimes, Hershey; Wilmer L. Sheesley, Dauphin, both of Pa.

[73] Assignee: AMP Incorporated, Harrisburg, Pa.

[21] Appl. No.: 124,363

[22] Filed: Feb. 25, 1980

[51] Int. Cl.[3] ..... H01R 13/00

[52] U.S. Cl. ..... 339/156 R; 339/22 R; 339/164 M

[58] Field of Search ..... 339/20, 21, 22, 23, 339/153–159, 163, 164, 166, 170, 172, 204, 205

[56] References Cited

U.S. PATENT DOCUMENTS

| | | | |
|---|---|---|---|
| 2,408,443 | 10/1946 | O'Brien | 339/170 |
| 2,565,075 | 8/1951 | Harcharek | 339/170 |
| 2,632,786 | 3/1953 | Hammerly | 339/155 R |
| 3,005,739 | 10/1961 | Lang et al. | 156/47 |
| 3,082,292 | 3/1963 | Gore | 174/117 |
| 3,263,131 | 7/1966 | Rowe | 317/116 |
| 3,346,834 | 10/1967 | Kinkaid | 339/217 |
| 3,444,506 | 5/1969 | Wedekind | 339/99 |
| 3,745,515 | 7/1973 | Michaels | 339/156 R |
| 3,998,517 | 12/1976 | Griffin | 339/164 M |
| 4,020,540 | 5/1977 | Casciotti et al. | 29/749 |
| 4,035,897 | 7/1977 | Over et al. | 29/56.5 |
| 4,043,626 | 8/1977 | Propst et al. | 339/23 |
| 4,130,040 | 12/1978 | Donnally et al. | 83/389 |
| 4,135,775 | 1/1979 | Driscoll | 339/22 R |
| 4,146,287 | 3/1979 | Jonsson | 339/75 M |

*Primary Examiner*—Joseph H. McGlynn
*Attorney, Agent, or Firm*—Allan B. Osborne

[57] ABSTRACT

The present invention is a power distribution system for electrification of modular wall panels. More particularly the invention includes a power box having a plurality of buss bars which provides multiple tap-off capabilities.

5 Claims, 10 Drawing Figures

POWER DISTRIBUTION SYSTEM

BACKGROUND OF THE INVENTION

1. The Field Of The Invention

The present invention is in the field of wiring systems for movable room dividers or modular wall panels for offices and the like.

2. The Prior Art

U.S. Pat. Nos. 4,043,626 and 4,135,775 exemplify the contemporary art with respect to providing electrical current in movable walls or panels as such are called.

In U.S. Pat. No. 4,043,626 a track system is disclosed wherein the sections have passageways for electrical cable. Outlets are provided at predetermined locations along the track sections.

U.S. Pat. No. 4,135,775 discloses electrical outlet boxes which are fixed in the panels. The outlet boxes are proportional in length from end to end to the width of the respective panels from edge to edge. By varying the length of the outlet boxes, the length of the electrical wiring between boxes is the same regardless of the panel width.

SUMMARY OF THE INVENTION

The present invention provides a power distribution system including a power box having five buss bars which provide four hot line contacts, four neutral line contacts, four ground contacts, eight pass-thru contacts as well as a duplex receptacle. Further included are specialized buss bars which permit pass-thru contacts to be interchanged with hot line contacts so that the number of tap-offs through the duplex receptacles on any one system is greatly increased without overloading the system.

DETAILED DESCRIPTION OF THE PREFERRED EMBODIMENT

Figure 1:
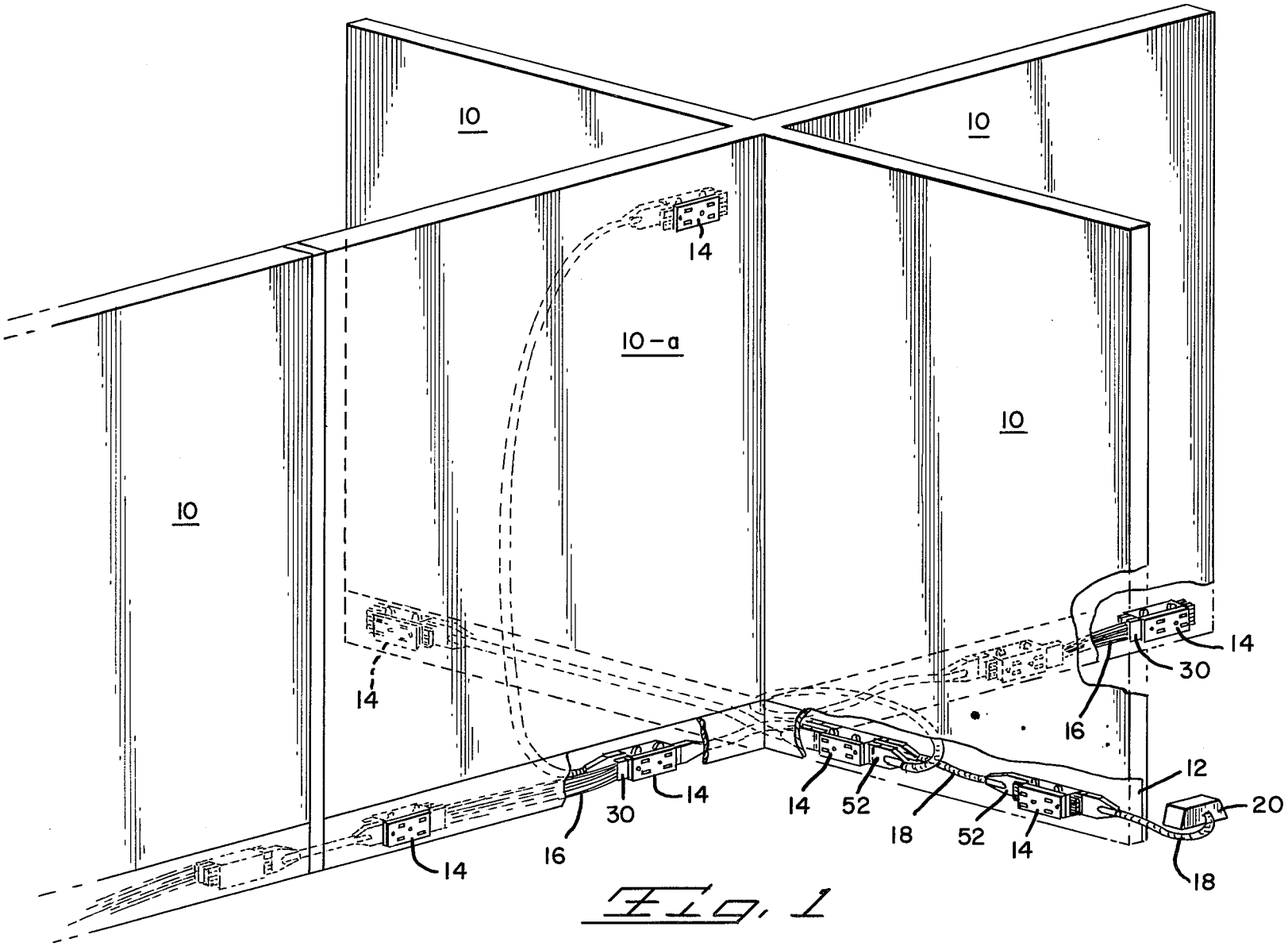
FIG. 1 is a perspective view showing modular wall panels incorporating the power distribution system of the present invention.

FIG. 1 shows a plurality of movable, modular wall panels 10, each of which are identical in constructional features and widths but may vary in length. The lower portions of each panel 10 provide a channel 12 in which the power distribution system is placed. Additionally, vertical spaces are provided in the panels to admit extending electrical wiring to locations in the panels other than along their lower portions.

A power distribution system, constructed in accordance to the preferred embodiment of the present invention is shown in FIG. 1 emplaced within panels 10 in various arrangements.

Power boxes 14 are located in the several panels in channels 12 and in one panel, designated by reference numeral 10-*a*, a box 14 is located adjacent the top. The several boxes are electrically joined by conventional electrical wiring; e.g. single or multiple stranded, insulated wiring having a number twelve (12) gauge. In some instances, the wires are discrete as seen in panel 10-*a* and designated by reference numeral 16. In other instances, the wires are enclosed in a flexible conduit, designated by reference numeral 18.

To the right of one panel is a permanently mounted electrical outlet, referenced by numeral 20. Outlets such as this called "tombstones" by those in the electrical trade, supply the electrical current to the power distribution systems such as the one disclosed herein.

Before leaving FIG. 1, the arrangement of power boxes and the wiring therein between, some being shown in solid and others in phantom, demonstrates the versatility of the power distribution system of the present invention.

Figure 2:
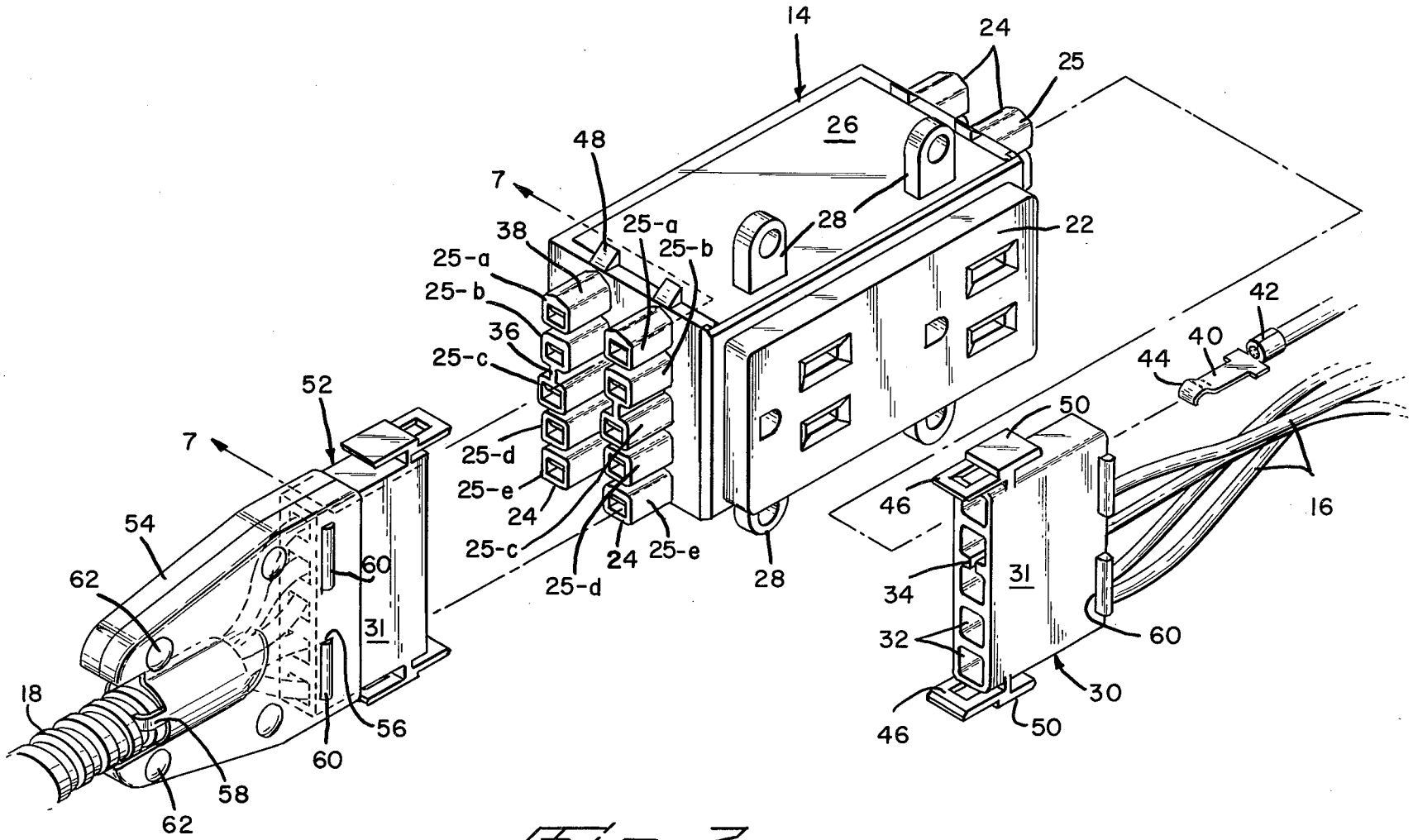
FIG. 2 is a perspective view of the power box of the power distribution system and the connectors used in conjunction therewith.

FIG. 2 shows in perspective power box 14 in an assembled condition ready for installation in a panel. The box itself is molded, a preferred material being a thermoplastic polycarbonate resin manufactured by General Electric Co. under the tradename LEXAN. A conventional duplex receptacle plate 22 is molded on the front face. The receptacle has narrow slots into which the blades (not shown) of an electrical plug are inserted. The receptacle also has semi-round openings to admit the ground prong found on most plugs. Two rows 24 of male shells 25-*a* through 25-*e* are moldings assembled to each longitudinal side of the box. The top and bottom surfaces 26 of the box have mounting ears 28 thereon. These ears provide one means for securing the box to a panel using, for example, conventional screws (not shown).

Two connectors are also shown in FIG. 2. The connector to the right, designated by reference numeral 30, includes a housing 31 molded from insulating material; e.g. LEXAN resin, and which has five sockets 32. A slot 34 between the second and third sockets receives bar 36 extending between two male shells, 25-*b* and 25-*c*, on power box 14 when the connector is plugged into the box. This of course provides a polarizing feature to prevent a mismatch. A second polarizing feature is the angled surface 38 on the top male shell 25-*a* which mates with a complementary-shaped socket on the connector.

connector 30 houses the terminated ends of five wires 16, one of which is shown exploded out of the connector to illustrate terminal 40. This type terminal has a wire barrel 42 which is crimped about a bared end of the wire. The front or mating end 44 of the terminal is bowed or curved to provide a hump. A side view of terminal 40 may be seen in FIG. 7 along with springs 45 which are staked in each socket 32.

Connector 30 plugs onto any of the four rows of male shells on a power box. It is retained thereon by a latching arrangement which includes flexible apertured plates 46 located on the top and bottom surfaces of housing 31 and studs 48 behind each row of male plugs. The forwardly facing surfaces of each stud is beveled to cam the apertured plate into latching engagement. Fingers 50, extending rearwardly from each apertured plate provides a means for lifting the plates out of engagement with studs 48 to remove the connector.

The connector to the left, indicated by reference numeral 52, is identical to connector 30 with respect to the housing and terminals. It differs in that a strain relief device 54 has been added. This device provides a link between armored, flexible conduit 18 and housing 31. Device 54 has two halves with holes 56 near one end and at another end a bent-in finger 58 for attachment to the armor cable. Housing 31 has a pair of bosses 60 on each side. The two halves of the strain relief device are fitted onto either side of the housing with the bosses protruding through holes 56. The two halves are secured together with conventional fastening means such as the rivets 62 shown.

Figure 3:
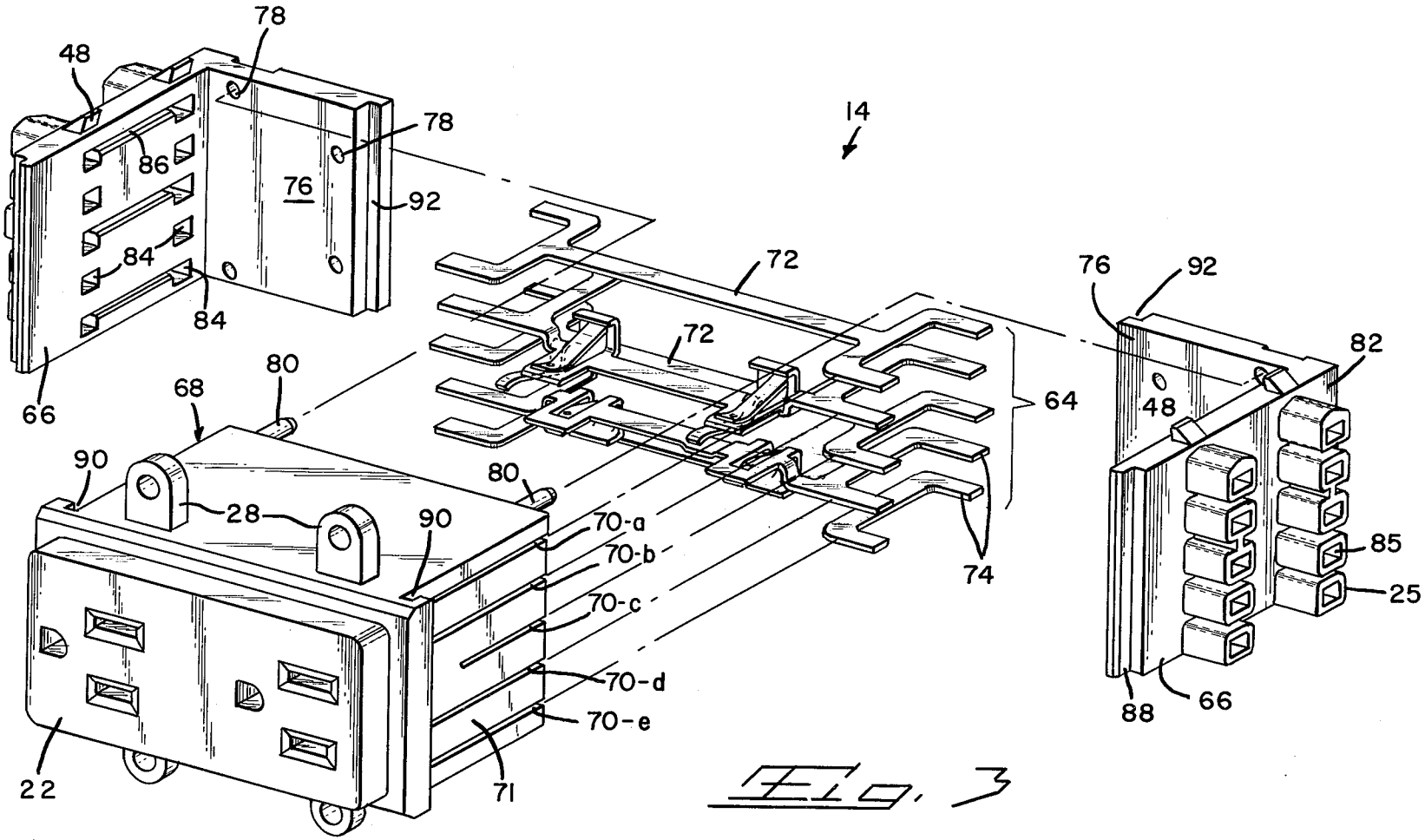
FIG. 3 shows the power box of FIG. 1 with its buss bars exploded thereout of and with the side covers removed.

FIG. 3 shows a power box 14 with buss bars, collectively designated by reference numeral 64, removed therefrom. The side covers 66 are also removed.

Figure 5:
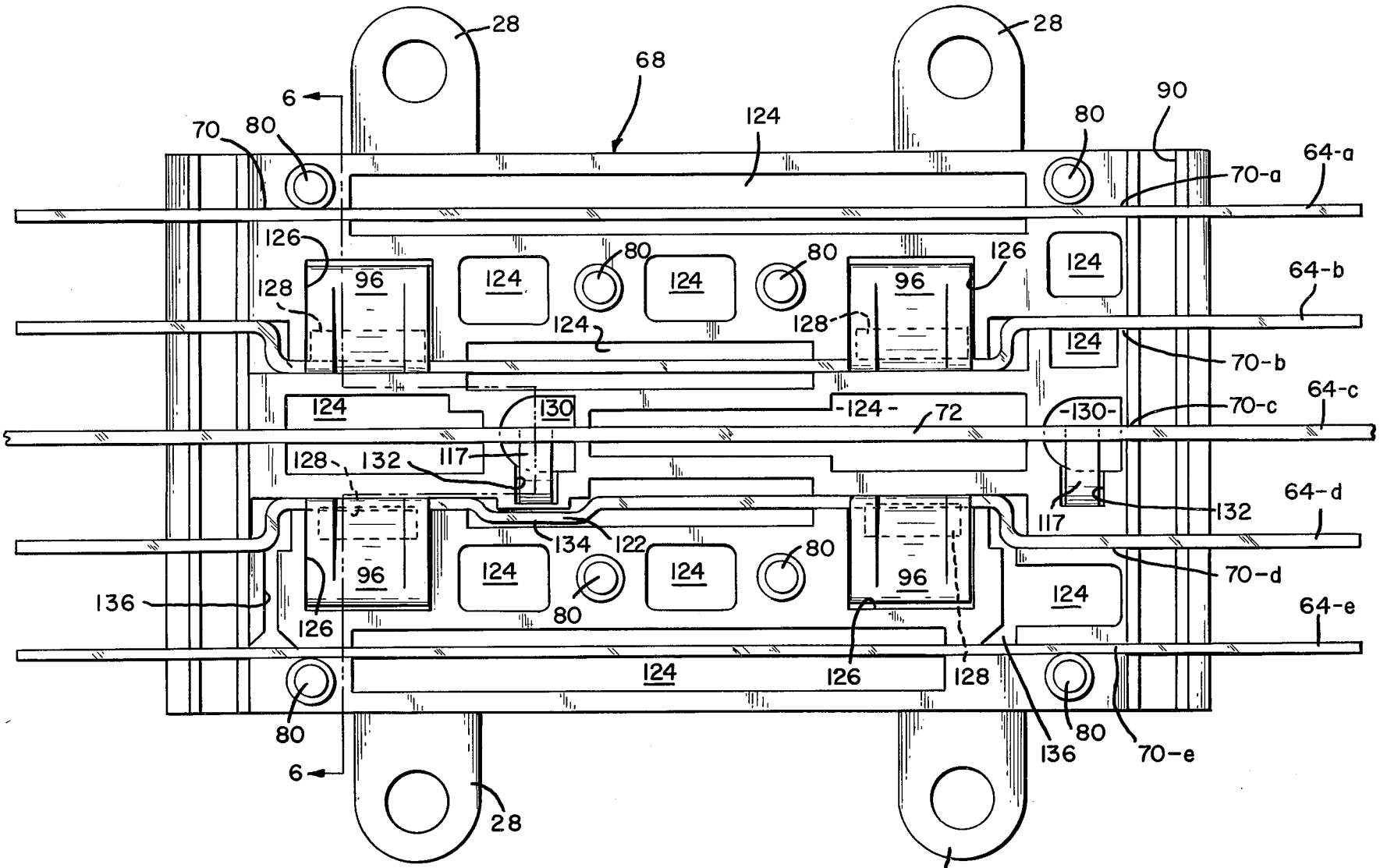
FIG. 5 shows the rear face of the power box of FIG. 3 with the buss bars positioned therein.

The major component of the box in terms of size is housing 68 which is preferably molded using LEXAN resin. In addition to the duplex receptacle plate 22, elongated, horizontal bar-receiving slots 70 a through e extend into the housing from the back face (FIG. 5). As shown in FIG. 3, slots 70 also open out onto sidewalls 71 of the housing.

The buss bars consist of a mid-section 72 and contact-carrying end sections 74 on either end of the mid-section.

The side covers 66 are L-shaped so as to include a flap 76 which covers, in combination, the back side of housing 68. The flaps have holes 78 which receive pegs 80 located on the back side.

The side portions 82 of covers 66 contain the aforementioned male shells 25 on the outer surface. Openings 84 extend through the shells and open out on the inner surface. Horizontal grooves 86 connect top, middle and bottom openings in the two rows but do not open out on the outer surface of the end portions. The openings 84 and grooves 86 are in alignment with slots 70 when the side covers are assembled onto housing 68.

Power boxes 14 may be assembled in the following manner. The buss bars are positioned just at the entrance of the appropriate slots on the back face of housing 68. The two side covers are then positioned so that the contact-carrying end sections 74 of the buss bars are positioned in openings 84 and grooves 86. The inner surfaces of side portions 82 abut sidewalls 71. With pressure being applied equally to the side covers, they and the buss bars are slid forward as a unit, with pegs 80 entering holes 78 and a lip 88 on the end portions 82 entering a vertical groove 90 on end walls 71 of housing 68. The flaps also have lips 92 that form a lap joint when the end covers are fully home. The pegs and holes provide a means of attachement, known as "cold heading", i.e., the pegs are struck to flatten the free ends over the walls defining the holes, much in the same manner as in riveting.

Figure 4:
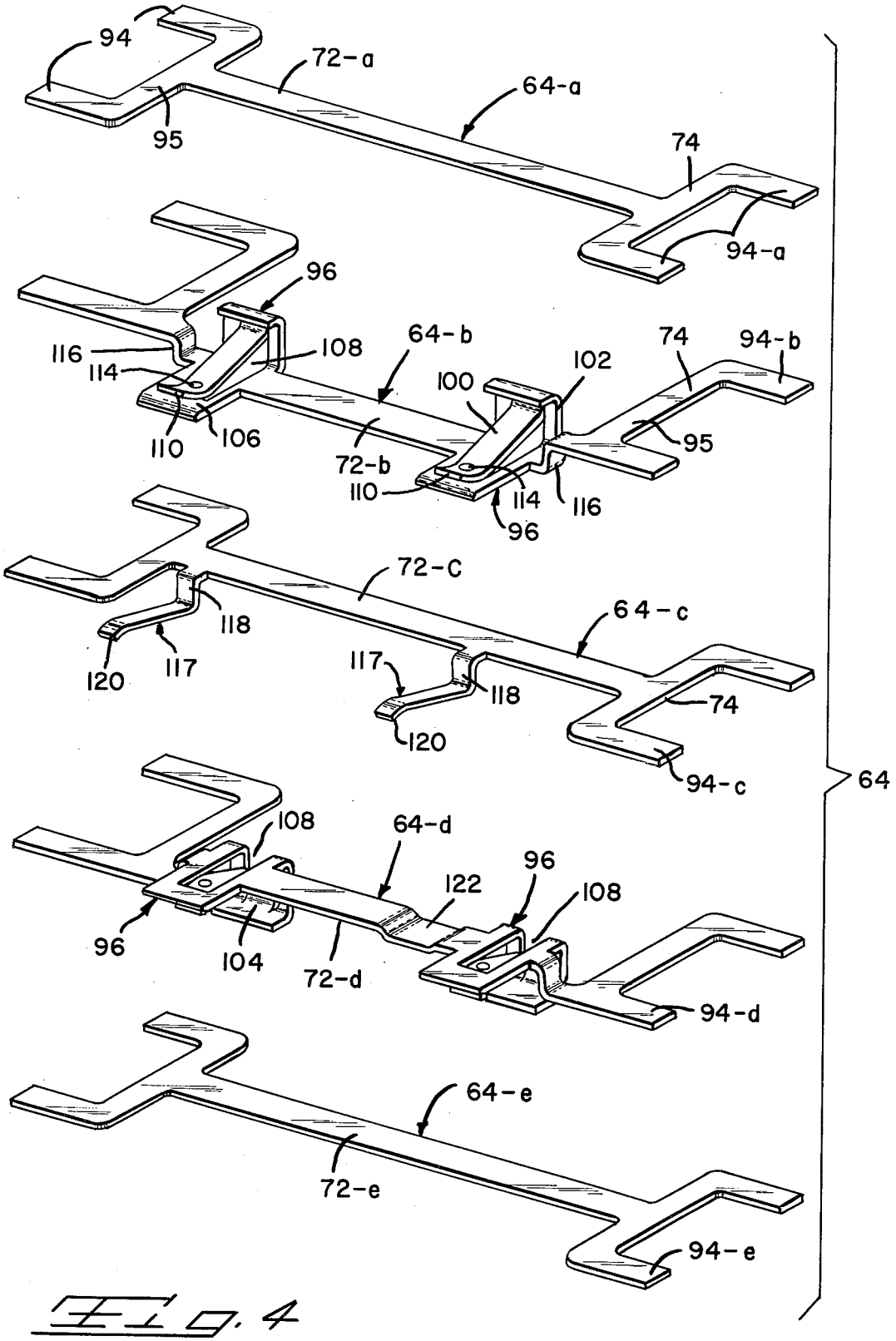
FIG. 4 shows in perspective and in larger scale, the buss bars of FIG. 3.

FIG. 4 shows buss bars 64 in greater detail. Each bar is separately identified by a letter following reference numeral 64. Beginning at the top buss bar **64-*a* includes the aforementioned straight mid-section 72-*a* and the U-shaped contact-carrying end section 74. Each end section 74 has two contacts which are the short legs, designated by reference numeral 94, which project outwardly from bight 95. The mid-section of buss bar 64-*a* joins the end section at the mid-point of bight 95**.

Buss bar **64-*a*** is stamped and formed from coplanar stock. The preferred material is copper alloy.

The second buss bar, **64-*b*, has the same four contacts 94 as bar 64-*a*. Note that the mid-section joins the end sections at the front rather than the middle of bight 95. Mid-section 72-*b* contains a pair of spaced-apart, blade-receiving receptacles 96**.

The steps in forming receptacles 96 begin with blanking out aligned rearwardly and forwardly extending tabs at two predetermined locations along mid-section **72-*b*. A cantilever beam 100 which extends along for about three quarters of the length of both tabs, is blanked out with one end hinged to rear tab 102 as indicated by reference numeral 104. Buss bar 64-*d* shows the hinge area more clearly. Thereafter rear tab 102 is bent ninety degrees with the bend being as close to the mid-section as possible so that the beam 100 will extend beyond space 108 on front tab 106; i.e., the free end 110 of beam 100 will rest on metal on the free end of front tab 106. Note that free end 100 of the beam is turned up in the manner of the front end of a ski. This of course facilitates the insertion of a blade on an electrical plug (not shown). A dimple 114 is embossed on the free end 110** of the beam to provide a high pressure contact point with the blade.

The free end of rear tab 102 is bent forward providing added strength to the receptacle.

The mid-section **72-*b* and receptacles 96 are displaced downwardly with respect to the end sections. The displacement is provided by making two right angle bends, indicated by reference numeral 116**.

Buss bar **64-*b*** is preferably stamped and formed from pre-tin-plated copper alloy.

The middle buss bar **64-*c* includes two fingers which provide ground contacts 117, both projecting forwardly from mid-section 72-*c*. Both contacts are displaced downwardly from the mid-section by right angle bends as indicated by reference numeral 118. The free ends 120 are bowed or curved. Note that ground contacts 117 are displaced to the left with respect to end sections 74**.

Contact-carrying end sections 74 and contacts **94-*c* are the same as on the other bars except that the legs comprising the contacts are longer than those on the other buss bars. The preferred material used in stamping and forming bar 64-*c*** is pre-tin-plated copper alloy.

Buss bar **64-*d* is identical to bar 64-*b* except for two differences. One difference is that mid-section 72-*d* and receptacles 96 are displaced upwardly with respect to end sections 74. The second difference is the presence of a jog 122 in the mid-section adjacent to the right hand receptacle. The jog accommodates ground contact 117 on bar 64-*c*** when the buss bars are loaded in the power box.

As with buss bar **64-*b*, mid-section 72-*d* is on line with the forward contact 94**.

Buss bar **64-*d* is stamped and formed in the same manner as bar 64-*b*** and from the same material.

Buss bar **64-*e* is identical to buss bar 64-*a*** in all respects.

FIG. 5 is a view looking into the back of power box housing 68. Shown are the horizontal slots and the buss bars positioned therein.

Buss bar 64-*a* slides into slot 70-*a*. As the drawing shows, portions of the slot are much to large for mid-section 72-*a*. As narrower portions of slot 70-*a* on either side fully support the bar, the enlargement or coring is simply for weight and material savings. In this regard, several other cored areas also designated by reference numeral 124, are provided for the same reason. As the several drawings show, the slots extend through housing 68 to just behind duplex receptacle plate 22.

Cavities 126 of slots 70-*b* and 70-*d* are provided to receive receptacles 96 on buss bars 64-*b* and 64-*d*. The rectangular shape shown in phantom in the cavities and called out by reference numeral 128, are the blade admitting slots in the duplex receptacle plate 22.

Two ground prong-admitted openings 130 are visible from the back of housing 68. Vertical slots 132, receive the ground contacts 117 on buss bar 64-*c*. As will be recalled, these ground contacts are displaced vertically downward with respect to mid-section 72-*c*: thus as the ground prongs are inserted into the opening from the front of the power box, they will rub against the upper surface of contact 117. The bowed or curved free ends 120 on the ground contacts will continuously exert pressure on the ground prongs for good electrical conductivity.

Slot 70-*d*, which receive buss bar 64-*d* has difference as compared to slot 70-*b* which receive bar 64-*b*. Slot 70-*d* has a jog, as indicated by reference numeral 134, to accommodate jog 122 on mid-section 72-*d* on bar 64-*d*. Vertical slots 136 extends between horizontal slots 70-*d* and 70-*e*. The purpose of these slots will be discussed below in conjunction with specialized buss bars 138 and 144.

Slot 70-*e* is almost identical with slot 70-*a* except for the above mentioned intersection by vertical slots 136.

Figure 6:
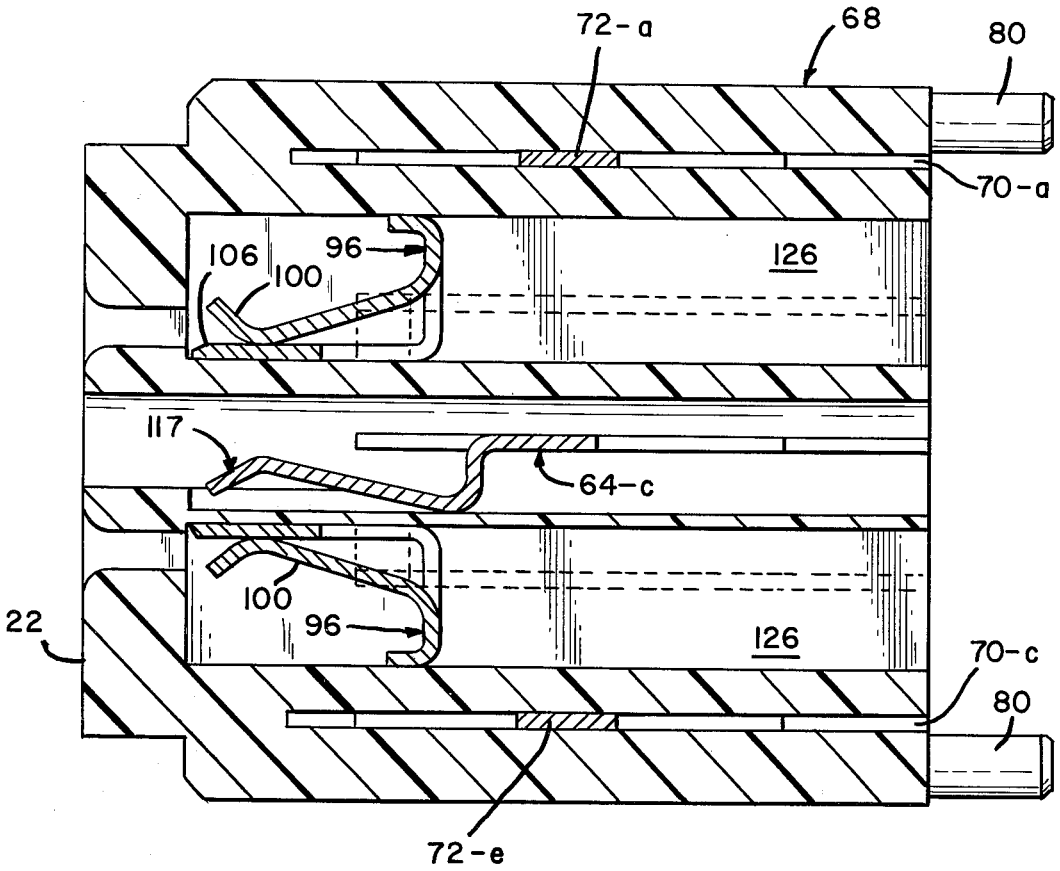
FIG. 6 is a cross-sectional view of the power box taken along lines 6—6 of FIG. 5.

FIG. 6 is a cross-sectional view looking into power box housing 68 from one end. This view clearly shows receptacles 96 on buss bars 64-*b* and 64-*d* and one ground contact 117. The view is taken along lines 6—6 of FIG. 5.

Figure 7:
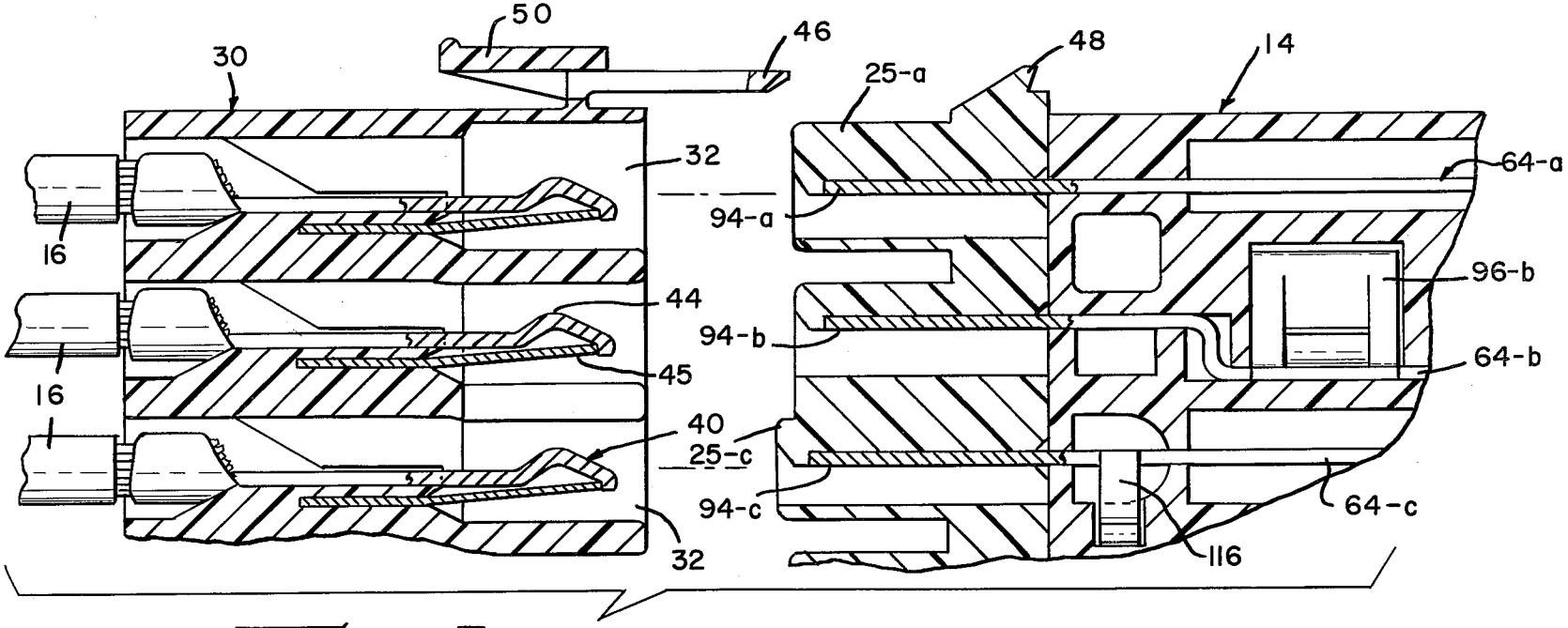
FIG. 7 is a cross-sectional view taken along lines 7—7 of FIG. 2, showing the female connector in relation to the male shells of the power box.

FIG. 7 is a cross-sectional view of part of power box 14 and connector 30. This view shows clearly the location of contacts 94 in the power box; i.e., positioned in shells 25, and terminals 40 in the connector. It also shows how the connector engages the power box. As the connector is plugged over the male shells, hump 44 on terminals 40 engage contacts 94. Springs 45 maintain pressure against the contacts for good electrical performance.

FIG. 7 also shows male shell 25-*c* and contact 94-*c* extending further outwardly than the other shells and contacts. As will be recalled, buss bar 64-*c* provides the ground for the system. Accordingly, the longer length of the shell and contact allows the ground to be made first and broke last for safety.

Power box 14 and connectors 30 and 52 provide a system wherein current is directed to duplex receptacles for distribution to electrical machines, lights and the like. However, as is well known, safety considerations dictate that a limited number of duplex receptacles feed off one line. Accordingly, the system would be limited to that number: however, the present invention provides a means for greatly increasing the number of duplex receptacles on a single system. These means will now be disclosed with reference to FIGS. 8, 9, and 10.

As FIGS. 5 and 6 show, buss bars 64-*b*, 64-*c* and 64-*d* provide current to the duplex receptacles. In the disclosed system, bar 64-*b* is the neutral line and bar 64-*d* is the hot line. Buss bars 64-*a* and 64-*e* are power-thru bars; i.e., they carry current across the box.

Figure 8:
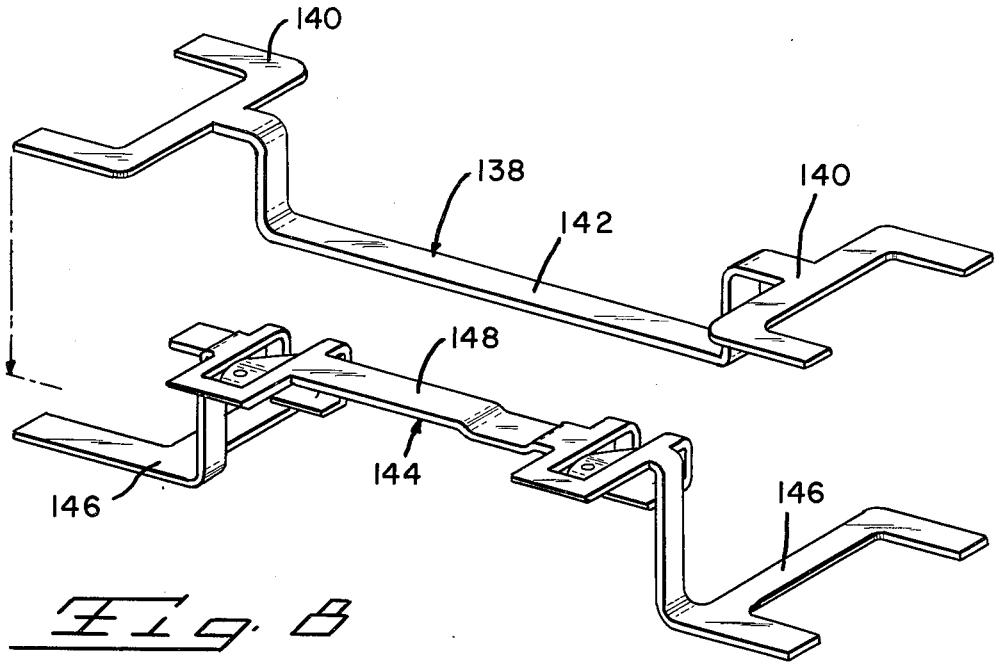
FIG. 8 shows in perspective two specialized buss bars.

At the point in the system where no more duplex receptacles can feed off bar 64-*d*, the specialized buss bars shown in FIG. 8 are substituted for bars 64-*d* and 64-*e*. These bars collectively are called "cross-over" bars. The top bar in FIG. 8, designated by reference numeral 138 is functionally and structurally similar to buss bar 64-*e*. The contact-carrying end sections 140 has been displaced upwardly relative to mid-section 142 by a distance about equal to the distance between slots 70-*d* and 70-*e* as measured on the end face of housing 68.

The second buss bar in FIG. 8, indicated generally by reference numeral 144, is functionally and structurally identifiable with buss bar 64-*d*. It differs in that the contact-carrying end sections 146 have been displaced vertically downwardly with respect to mid-section 148. The displacement distance is equal to the length of vertical slot 136 in housing 68.

The two buss bars 138 and 144 are stamped and formed from the same material as bars 64-*d* and 64-*e*.

Figure 9:
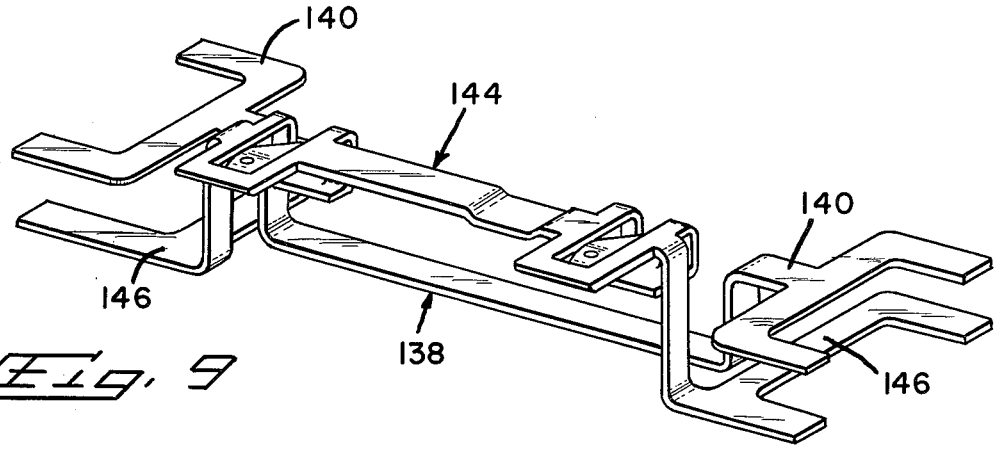
FIG. 9 shows the two specialized buss bars of FIG. 8 as they would be positioned with respect to one another in the power box.
Figure 10:
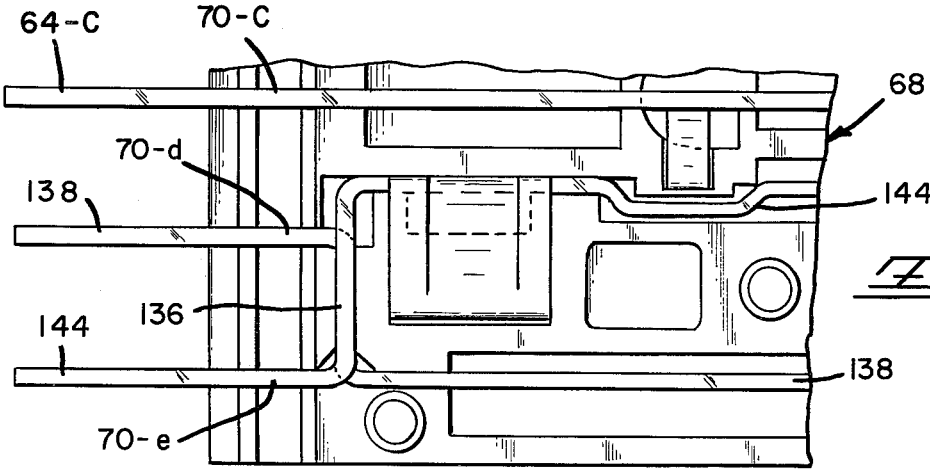
FIG. 10 is an enlarged view of a portion of the power box showing a portion of the specialized buss bars therein.

FIG. 9 shows the relative positioning of the two bars as they are when in housing 68 and FIG. 10 shows them actually in the housing. These specialized bars permit the transformation of a power-thru bar to a duplex receptacle hot line.

It is to be understood that the forms of the invention shown and described herein are but preferred embodiments thereof and that various changes and modifications can be made therein without departing from the spirit or scope of the invention.

What is claimed is:

1. A power box assembly useful in an electrical distribution system in modular wall panels, the power box comprising:

a. a rectangular housing of insulating material adapted to be mounted in a modular wall panel and having a duplex receptacle plate with blade-admitting slots and prong-admitting openings on the front face, and first, second and third horizontal slots extending into the housing from the back face with the slots and openings of the duplex receptacle plate intersecting the horizontal slots;

b. a plurality of laterally extending shells arranged in two vertical rows on each side of the housing and having openings which are in alignment with the horizontal slots in the housing, said shells each adapted to receive therein an electrical terminal.

c. first and second buss bars each having contact-carrying end sections joined by an elongated mid-section with spaced-apart, blade-receiving receptacles on the mid-section, said end sections being U-shaped with the bight positioned normally to the mid-section and the legs providing contacts, said first and second bars being positioned in the first and second horizontal slots in the housing with the receptacles being in alignment with the blade-admitting slots in the duplex receptacle plate, and the contacts extending into the shells for electrical contact with terminals which may be inserted therein; and d. a third buss bar having contact-carrying end sections joined by an elongated mid-section, said end sections being U-shaped with the bight positioned normally to the mid-section and the legs providing contacts, said bar further having spaced-apart fingers extending forwardly from the mid-section, said third buss bar being positioned in said third horizontal slot positioned between the first and second horizontal slots with the fingers being in alignment with the prong-admitting openings in the duplex receptacle plate and the contacts extending into the shells for electrical contact with terminals which may be inserted therein.

2. The power box assembly of claim 1 further including fourth and fifth horizontal slots and fourth and fifth buss bars adapted for conducting an electrical current across the power box, said fourth and fifth bars each having two contact-carrying end sections joined by an elongated mid-section, said end sections being U-shaped with the bights positioned normally to the mid-section and the legs providing electrical contacts, said fourth bar positioned in said fourth slot located immediately above the first buss bar and said fifth bar positioned in the fifth slot located immediately below the second buss bar, and with the contacts of both extending into shells on the sides of the housing for electrical contact with terminals which may be inserted therein.

3. The power box assembly of claim 2 further including vertical slots connecting the second and fifth horizontal slots in which are positioned the second and fifth buss bars and also including sixth and seventh buss bars having contact-carrying end sections joined by an elongated mid-section, said end sections being U-shaped with the bight positioned normally to the mid-section and the legs providing contacts, the mid-sections on the sixth buss bar being vertically displaced downwardly with respect to its end sections and the mid-section of the seventh buss bar being vertically displaced upwardly with respect to its end sections and further having thereon spaced-apart blade-receiving receptacles, said sixth and seventh buss bars adapted to replace the second and fifth buss bars respectively with the mid-section of the sixth buss bar positioned in a portion of the fifth horizontal slot and the contact-carrying end sections extending into the shells adjacent the second horizontal slot, and the mid-section of the seventh buss bar positioned in a portion of the second horizontal slot with its blade-receiving receptacles in alignment with the blade-admitting slots, and the contact-carrying end sections extending into the shells adjacent the fifth horizontal slot.

4. The power box assembly of claim 3 wherein the receptacles on the first, second and seventh buss bars include a cantilever beam hinged to a vertically extending tab located on the back edge of mid-section and which extends forwardly to project over a horizontal tab located on the front edge of the mid-section, said beam being movably biased against the upper surface of the horizontal tab to removably retain a blade which may be inserted between the horizontal tab and cantilever beam.

5. The receptacles of claim 4 produced in accordance with the following, sequential steps:

a. providing a coplanar sheet of conductive material and stamping out therefrom an elongated strip having aligned front and back tabs extending from the front and back edges respectively of the strip;

b. forming an elongated beam by blanking out two sides and one end from the tabs and intermediate strip with the second end of the beam remaining attached to the back tab;

c. bending the back tab upwardly ninety degrees with respect to the strip; and d. biasing the free end of the beam downwardly to abut against the upper surface of the front tab.

* * * * *